US005401094A

United States Patent [19]

Walsten

[11] Patent Number: 5,401,094

[45] Date of Patent: Mar. 28, 1995

[54] VARIABLY MOUNTED RECESSED MEDICINE CABINET

[76] Inventor: Mark E. Walsten, 1683 Van Buren, Des Plaines, Ill. 60018

[21] Appl. No.: 103,862

[22] Filed: Aug. 9, 1993

[51] Int. Cl.[6] ..... A47B 67/02

[52] U.S. Cl. ..... 312/242; 312/245

[58] Field of Search ..... 312/242, 245, 204, 291

[56] References Cited

U.S. PATENT DOCUMENTS

| | | | |
|---|---|---|---|
| 1,442,588 | 1/1923 | Tompkins | 312/242 |
| 2,678,252 | 4/1954 | Swearingen | 312/242 |
| 3,140,134 | 7/1914 | Nairn | 312/204 |

*Primary Examiner*—Kenneth J. Dornier
*Assistant Examiner*—Gerald A. Anderson
*Attorney, Agent, or Firm*—Charles F. Lind

[57] ABSTRACT

The disclosed recessed medicine cabinet uses separate cabinet components related to a flush mounted cabinet and a recessed cabinet, each having a rear wall and peripherial walls projected forwardly therefrom and defining a storage space. The flush mounted cabinet component is larger both horizontally and vertically than the recessed cabinet component and a framed opening in a structural wall, suited to be mounted flush against the structural wall over the framed opening. The recessed cabinet component peripherial walls are sized to fit into the framed opening, and through an opening in the flush mounted cabinet component rear wall. The overall medicine cabinet storage space is comprised of both cabinet component storage spaces, the recessed cabinet component storage space lying rearwardly of the flush mounted cabinet component storage space. The flush mounted cabinet component can be positioned on the structural wall over the framed opening somewhat independently of its location, as the rear wall opening is located and formed on site as needed during cabinet installation to expose the framed opening for insertion of the recessed cabinet component into the framed opening.

6 Claims, 2 Drawing Sheets

VARIABLY MOUNTED RECESSED MEDICINE CABINET

BACKGROUND OF THE INVENTION

A medicine cabinet is commonly provided on one of the walls in a domestic bath room to offer space for the convenient storage of personal use appliances, chemical aids and even medicines of its regular users. Common tools might include hand razors and/or power shavers, hand and/or power tooth brushes or irrigators, and hair dryers, combs and brushes; while the chemical aids catagory might include containers for powders, creams or liquids of dentifrices, lotions, deodorants, soaps, shampoos and cosmetics.

Two basic forms of medicine cabinets are commonly used: a flush mounted cabinet, and a recessed cabinet. Standard cabinet sizes further have evolved, including inside height, width and front-to-rear or depth storage spaces. While the cabinets are available in many height and width combinations, the depth storage spaces of most commercially available medicine cabinets are all about the same: at or just exceeding four inches as a minimum.

The flush mounted medicine cabinet fits against and is only on the exterior surface of the room wall. Its major appeal is that it can be easily installed without significantly altering most wall constructions, being common therefore as a remodeling project cabinet. Its major drawback includes its projection forwardly away from the wall, which including the thicknesses of the rear cabinet wall and front closure door and possible decorative door or cabinet trim, can exceed five inches. Thus, common complaints of a flush mounted cabinet, particularly a large one centered and overlying most or all of a vanity, are its massive appearance and its obstruction of the rear portions of the vanity top surface.

The recessed cabinet fits through an opening in the wall surface and into the wall interior, in a special framed box opening interrupting the vertical extent of one or more wall studs or between adjacent wall studs structurally forming the wall. The wall would typically be formed by conventional 2"×4" wall studs, so that about three plus inches of the cabinet is fitted within the wall framing and about one plus inches of the cabinet is projected forwardly from the exterior wall surface. Commercially available recessed cabinets have been fabricated with different standard widths: one about fourteen inches wide, allowing it to be fitted between adjacent wall framing studs spaced apart on sixteen inch centers; and several other both narrower and wider than this, including a sixteen inch wide recessed cabinet widely used in many upgrade homes since the 1940's.

The small forward projection of a recessed cabinet is its major appeal; while its major drawback is the permanency of its framed box opening. Fabrication of the framed box opening does not add significantly to the overall framing cost if completed with the wall framing, while all is yet exposed. For these reasons, recessed medicine cabinets probably are the preferred choice of new construction. However, replacing an existing framed box opening with another to accommodate a recessed cabinet differing in size and/or location, will generally require expensive major wall reconstruction. Without it, the adjacent wall boards must remain and be exposed after the remodeling, and fabrication of a new box framing without distrubing these adjacent structures would require great carpentry skills and effort. In fact, the task might even be impossible should piping or conduits in the wall be in the way, and incapable of being relocated.

By contrast to the remodeling problems of a recessed cabinet, the size and location of a new vanity can be changed quite easily, as the wall boards to be hidden by the new vanity can be removed to expose and/or relocate the water or drain lines as needed, and/or new water or drain lines can be routed between the original wall connections and the newly added vanity sink while remaining hidden within the vanity. Further, a new flush mounted cabinet could merely be mounted over the original framed box, thereby hiding it without redoing it. Thus, should a limited budget and/or limited carpentry skills remain factors in a remodeling project, one might be forced to go with a new vanity sized and/or located as desired and use a flush mounted medicine cabinet to complementing the new vanity.

SUMMARY OF THE INVENTION

This invention relates to medicine cabinets adapted to be mounted on or in a room wall, and more specifically to medicine cabinets that can be effectively mounted at many alternative positions along the room wall as part of an easy relatively inexpensive remodeling project.

The basic objects of the present invention are to provide an improved medicine cabinet having the convenience and ease of mounting on a room wall, similiar to a conventional flush mounted medicine cabinet, while having the visually appealing smaller forward projection from the room wall more related to a conventional recessed medicine cabinet, further while being usable at alternative locations along the room wall almost independently of the location and/or size of an original recessed cabinet being replaced, and further yet without the need of major reconstruction of the original wall.

Specific features of the present invention include separate hybrid cabinet components suited to cooperate together in virtually an infinate number of different alternative positions, the cabinet components generally corresponding respectively to flush mounted and recessed medicine cabinets with related rear walls and forwardly disposed but shortened side walls, whereby the flush mounted cabinet component forwardly projects from the wall more as would a conventional recessed cabinet and whereby the recessed cabinet component side walls terminate adjacent the rear wall of the flush cabinet component at a locally provided opening therein to communicate the storage spaces of the cabinet components together and provide thereby the depth storage space associated with a conventional recessed cabinet.

A related feature of the invention is a medicine cabinet construction that provides for easy installation, the flush cabinet component being mounted with its rear wall flush against the wall surface at the desired location thereon, and the recessed cabinet component being fitted through the locally provided opening in the rear wall of the flush mounted component and into the framed box opening of the original recessed medicine cabinet being replaced.

Other specific features of the present invention include the use of vertically spaced markings on each separate cabinet component suited when appropriately paired up to provide for proper relative orientation vertically of the cabinet components in several alternative positions, the use of separate shelves for the flush mounted component and for the recessed component and separate brackets securable to these cabinet components for holding the ends of the shelves, and providing that the brackets of the recessed cabinet component also underlie and support the related shelves of the flush mounted component intermediate their ends and with the different component shelves horizontally aligned.

BRIEF DISCRIPTION OF THE DRAWINGS

Further objects, advantages and features of the present invention will appear from the following disclosure and description, including as a part thereof the accompanying drawing, in which.

Figure 1:
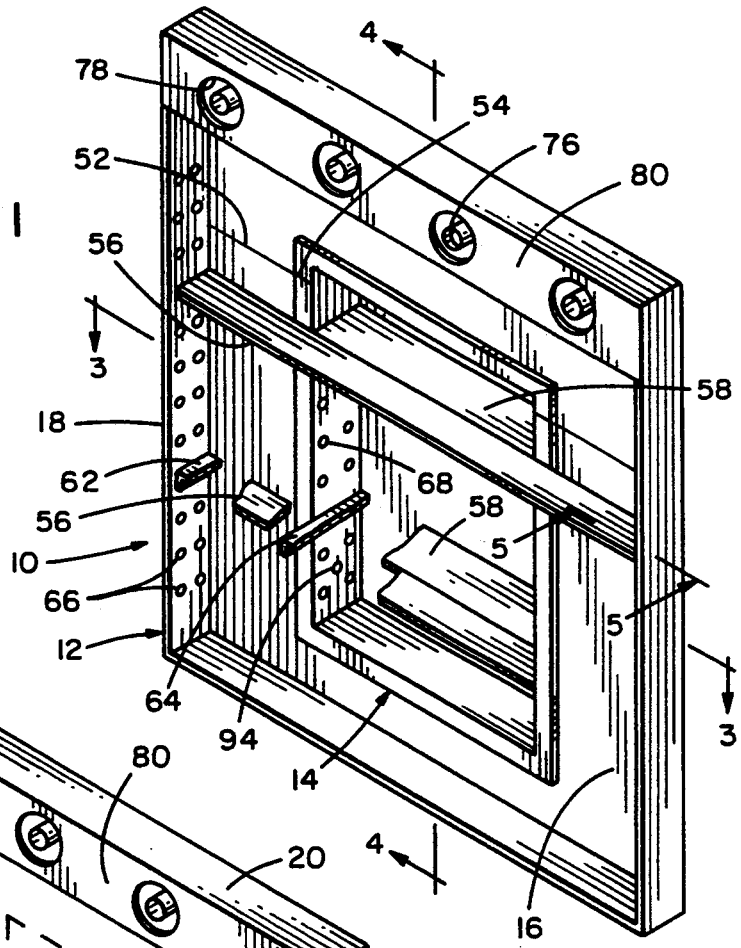
FIG. 1 is a perspective view of a typical medicine cabinet that can be formed with the separate hybrid cabinet components, showing it without front closure doors and without other possible shelves, for clarity of disclosure.
Figure 2:
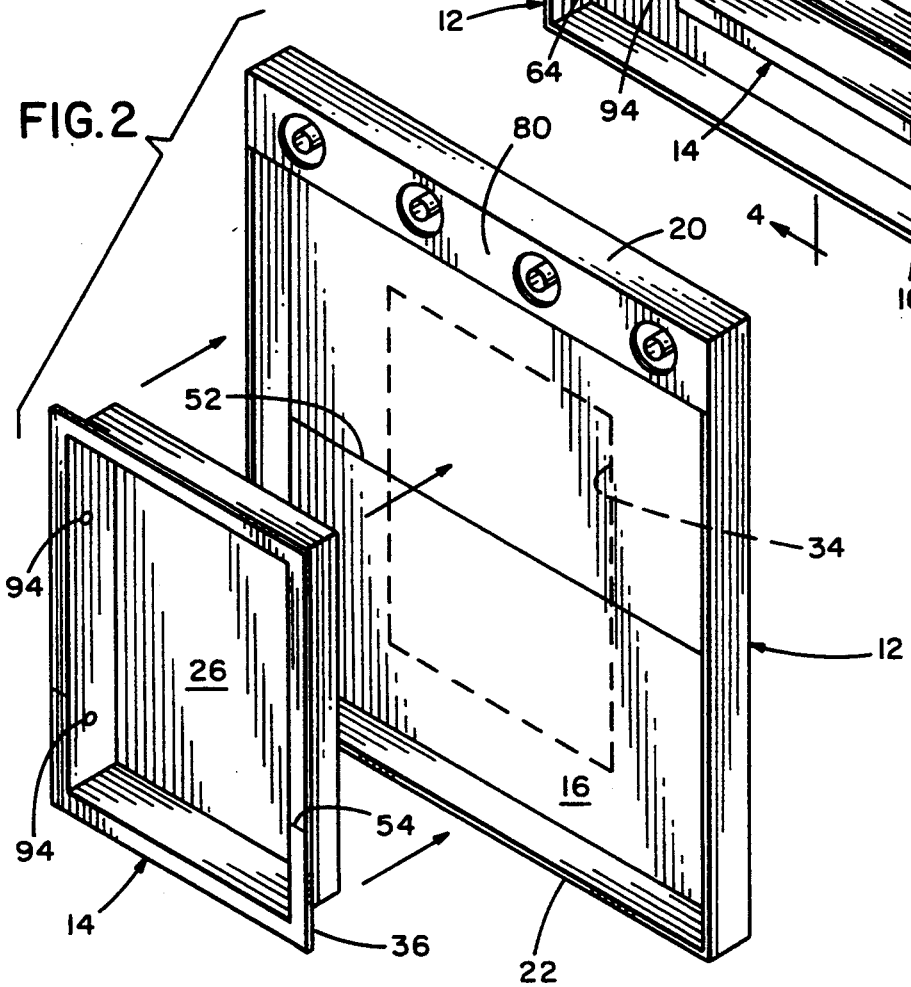
FIG. 2 is a perspective view of the separate hybrid cabinet components used in forming the medicine cabinet of FIG. 1, in a preassemblied orientation.
Figure 3:
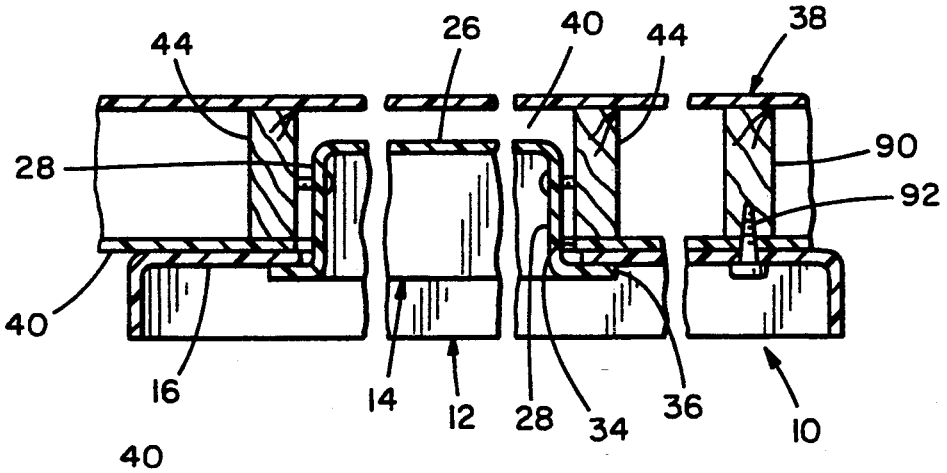
Figure 4:
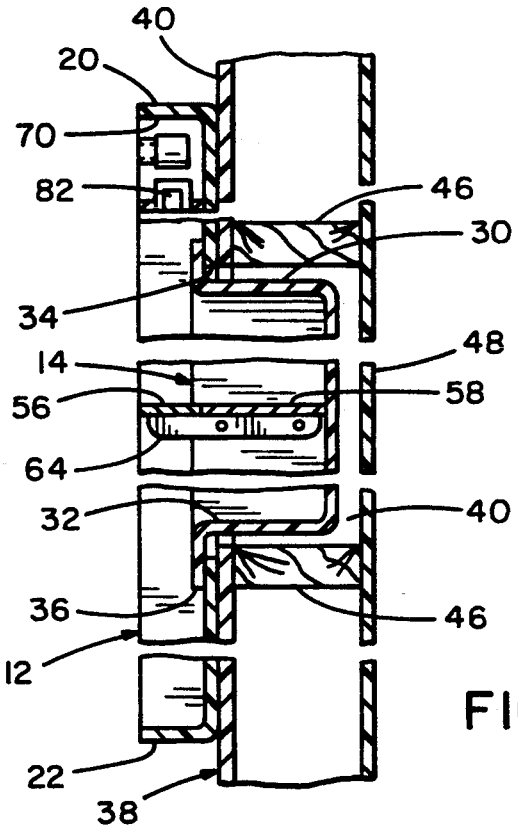
Figure 5:
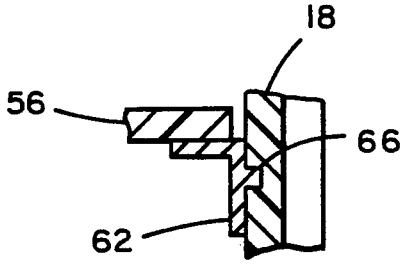
Figure 6:
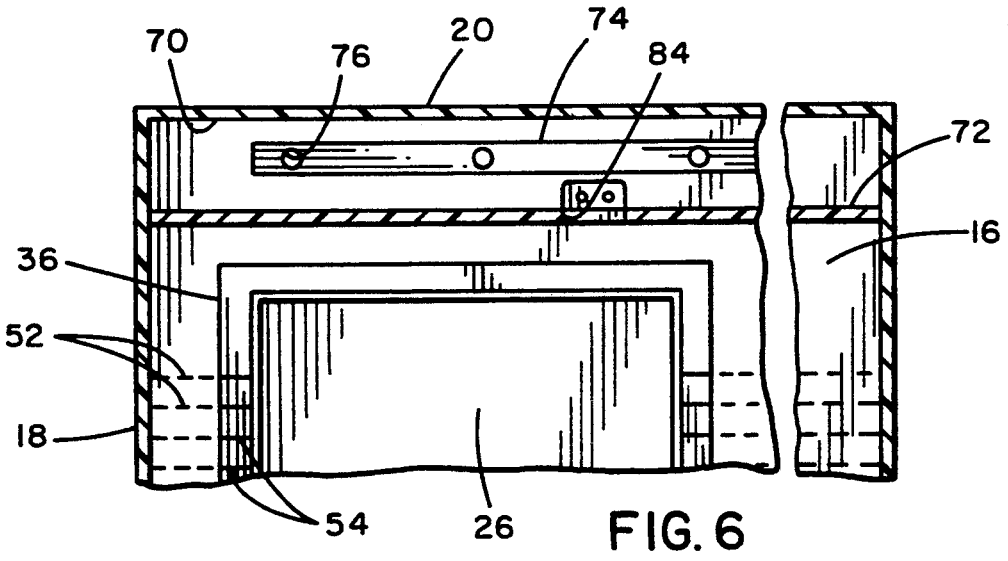

FIGS. 3, 4 and 5 are enlarged fragmentary sectional views, taken generally along lines 3—3, 4—4 and 5—5 respectively in FIG. 1; and FIG. 6 is a font elevational view of portions of the separate cabinet components, illustrating means for assemblying them.

DETAILED DESCRIPTION OF AN ILLUSTRATED EMBODIMENT

The medicine cabinet 10 illustrated in FIGS. 1 and 3-5 is comprised of a special flush mounted cabinet component 12 and a special recessed cabinet component 14 operatively connected together. Two shelves are .illustrated in the medicine cabinet 10 in FIG. 1, adjustably located to define appropriate vertically separated compartments; although the number and location of the shelves can be varied and form no part of this invention. Conventional door closure structures associated with the open front of the flush mounted cabinet component 12 would close off and provide access to its defined interior storage space, but such has not been illustrated for clarity of disclosure of the invention.

Specifically, the flush mounted cabinet component 12 is conventional to the extent that it has a continuous generally flat rear wall 16; opposed side, top and bottom walls 18, 20 and 22 respectively projecting forwardly therefrom; and the non illustrated door closure structures closing off and providing access to the defined interior storage space. However, the side, top and bottom walls 18, 20 and 22 are foreshortened, providing only between one and two inches forward projection from the rear wall 16; as compared to the four and five inch forward projection of corresponding walls of a conventional flush mounted cabinet.

The recessed cabinet component 14 is conventional to the extent that it too has a generally flat rear wall 26, and opposed side, top and bottom walls 28, 30 and 32 respectively projecting forwardly therefrom. These walls 28, 30 and 32 fit through an opening 34 in the rear wall 16 of the flush mounted cabinet component 12. The illustrated side, top and bottom walls 28, 30 and 32 might typically have only about three inches of forward projection from the rear wall 26, slightly shorter than the four and five inch forward projection of corresponding walls of a conventional recessed cabinet, and terminate at flanges 36 extended outwardly along a plane generally parallel the rear wall 26 at the front cabinet opening. There is no door closure structure directly associated with the front of the recessed cabinet component 14.

The cabinet components 12 and 14 would preferably be made of an attractive plastic material, to be economically fabricated and durable against corrosion, while yet being attractive.

The medicine cabinet 10 will be extremely useful in a remodeling project where an existing recessed cabinet (not shown, but to be replaced) would be located in one room wall 38 at a specific location defined by a framed or boxed cabinet opening 40, comprised of spaced vertical frame members 44 (commonly adjacent wall studs) and spaced horizontal frame members 46 connected between the vertical frame members 44.

The cabinet component 12 would be mounted with its rear wall 16 flush against the exterior surface 40 of the room wall 38, at any desired horizontal and vertical location so long as it covers the boxed wall opening 40, but otherwise virtually independent of the relative location of underlying wall opening and cabinet component 12. In doing this, only the general location of the framed wall opening 40 need be marked on the exposed rear wall of the cabinet component 12 before securing it to the room wall, whereupon the exact opening 36 can be cut in the rear wall 16 to expose then the underlying wall opening.

The recessed cabinet component 14 by contrast, is sized no larger than the replaced recessed cabinet and thus will fit in the framed wall opening 40. When so positioned, the recessed cabinet component 14 would be secured to the frame members 44 and 46 as needed, and the flanges 36 would overlap and lie flush against the exposed face of the rear wall 16 of the cabinet component 12.

Specifically, the recessed cabinet component 14 will fit exactly as intended in the existing framed wall opening 40, with possibly three plus inches recessed within the wall, while not contacting the opposite wall board 48 and while having its flanges 36 flush against the exposed rear wall of the cabinet component 12. In this regard, it is preferred to keep the flanges 36 thin and/or have tapered edges thereon to blend in attractively with the exposed rear wall 16. The flush mounted cabinet 12 would have approximately the same forward projection of a conventional recessed cabinet, about two inches, to offer the same visual appeal.

The overall defined storage space of the cabinet 10 would be comprised of that within the flush cabinet component 12 overall yielding possibly two inches deep space, and the three plus inch deep space defined in the recessed cabinet component 14. The door structures (not shown) on the flush mounted cabinet 12 would provide access to this combined medicine cabinet storage space.

For accurate installation of the cabinet components 12 and 14 on the wall structure, each has vertically spaced markings on the exposed faces thereof, such as parallel horizontal lines 52 extended across the rear wall 16 and parallel horizontal lines 54 extended across the vertical flanges 36. When these respective markings 52 and 54 are aligned horizontally, the cabinet components 12 and 14 will be accurately paired vertically relative to one another.

Separate shelves 56 and 58 are provided for the flush mounted and recessed cabinet components 12 and 14, each suited to span the full width and depth of the respective cabinet component. Likewise, separate brackets 62 and 64 are suited to be secured in any of many pairs of vertically spaced horizontally aligned openings 66 and 68 in each of the respective cabinet components, to support the ends of the shelves. Further, the recessed cabinet brackets 64 are long enough to underlying and support the intermediate portions of the flush mounted cabinet shelves. When so properly mounted, the shelves 56 and 58 will also be horizontally aligned with one another.

An electrical utility compartment 70 defined by wall 72 in the medicine cabinet 10 across the top of the flush mounted cabinet would provide for enclosing a light bar 74 having screw sockets 76 exposed through openings 78 formed in a face plate 80. Also, a ground fault outlet 82 would be located in the utility compartment 70 and exposed through an opening 84 in the wall 72 to the storage space within the cabinet component 12.

In will be apparent that the flush mounted cabinet component must be larger both horizontally and vertically than its cooperating recessed cabinet component. To minimize having inadequate vertical clearance needed between the recessed cabinet component 14 and the framed wall opening to bring the markings 52 and 54 and thus the openings 66 and 68 into proper registry, the height of the recessed cabinet component can be made less than that of the conventional recessed cabinet by the vertical distance between the markings and openings, or the vertical separation between markings and the openings can be very small. Mounting openings in rear wall 16 of flush cabinet component 12 must be drilled individually, aligned with the wall studs (such as 90), for the mounting screws 92; while preformed openings 94 in side walls 28 of cabinet component 14 allow for threading mounting screws into the adjacent vertical framing members 44.

The flush mounted cabinet component 12 can be centered, or horizontally and/or vertically postioned as needed relative to any underlying vanity or the like (not shown); while by contrast, the recessed cabinet component 14 need not have any set position relative to the flush mounted cabinet component. In this manner, the recessed cabinet component 14 can utilize the existing framed wall opening to provide full depth storage space, providing the improved medicine cabinet 10 having virtually all of the benefits of both flush mounted and recessed cabinets, without their drawbacks.

While a specific embodiment of the invention has been illustrated, it is apparent that variations may be made therefrom without departing from the inventive concept. Accordingly, the invention is to be limited only by the scope of the following claims.

What is claimed as my invention is:

1. A recessed medicine cabinet mounted on a structural wall relative to and over a framed opening in the wall, comprising the combination of separate cabinet components each having a rear wall and peripherial walls projected forwardly therefrom and defining a storage space, the cabinet components being a flush mounted cabinet and a recessed cabinet;

the flush mounted cabinet component being larger both horizontally and vertically than the recessed cabinet component and the framed opening, and the recessed cabinet component peripherial walls being sized to fit into the framed opening;

the rear wall of the flush mounted cabinet component having an opening aligned with the framed opening, and the recessed cabinet peripherial walls being fitted through the rear wall opening and into the framed opening, thereby defining an overall medicine cabinet storage space comprised of both cabinet component storage spaces with the recessed cabinet component storage space lying rearwardly of the flush mounted cabinet component storage space;

flanges extended from the peripherial walls of the recessed cabinet component overlapping the rear wall of the flush mounted cabinet component about the opening therein; and the flush mounted cabinet component being installed relative to the structural wall over the framed opening but otherwise substantially independently of its location, as the rear wall opening is located and formed on sits during cabinet installation as needed to be in alignment with the framed opening and allow the recessed cabined component to be fitted through the rear wall opening and into the framed opening.

2. A recessed medicine cabinet according to claim 1, further comprising the cabinet components having vertically spaced markings thereon for locating the cabinet components vertically relative to one another.

3. A recessed medicine cabinet according to claim 1, further comprising shelves for each of the cabinet components, each shelf spans the full width and depth of one or the cabinet components, and separate brackets secured to each cabinet component to support ends of each shelf.

4. A recessed medicine cabinet according to claim 1, further comprising the cabinet components having vertically spaced markings thereon for locating the cabinet components vertically relative to one another; shelves for each of the cabinet components, each shelf spans the full width and depth of one of the cabinet components; and separate brackets secured to each cabinet component to support ends of each shelf; and some of the brackets secured to the recessed cabinet component being elongated forwardly from the recessed cabinet component rear wall to underlie and support the shelves of the flush mounted cabinet component intermediate their respective ends.

5. A recessed medicine cabinet according to claim 1, further comprising structure defining an electrical utility compartment in the medicine cabinet across the top wall of the flush mounted cabinet component, a light bar enclosed in the compartment and having screw sockets exposed through openings formed in the flush mounted cabinet component, and an electric outlet enclosed in the utility compartment but operatively exposed to the storage space defined within the flush mounted cabinet component.

6. A recessed medicine cabinet according to claim 1, further comprising the perpherial walls of the separate cabinet components being foreshortened to less than four to six inches corresponding to the depths of conventional flush mounted and recessed medicine cabinets.

* * * * *